US007168581B2

(12) United States Patent
Robinson et al.

(10) Patent No.: US 7,168,581 B2
(45) Date of Patent: Jan. 30, 2007

(54) CLOSURE FOR A RETORT PROCESSED CONTAINER HAVING A PEELABLE SEAL

(75) Inventors: Clayton L. Robinson, Elberfeld, IN (US); Gary V. Montgomery, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 10/628,599

(22) Filed: Jul. 28, 2003

(65) Prior Publication Data

US 2004/0055992 A1 Mar. 25, 2004

Related U.S. Application Data

(63) Continuation-in-part of application No. 10/026,161, filed on Dec. 21, 2001.

(51) Int. Cl.
*B65D 53/04* (2006.01)
*B65D 41/34* (2006.01)
*B65D 39/00* (2006.01)

(52) U.S. Cl. ..... 215/349; 215/350; 215/252; 215/232

(58) Field of Classification Search ..... 215/232, 215/349, 350, 351, 347, 252, 341; 428/36.6–36.8
See application file for complete search history.

(56) References Cited

U.S. PATENT DOCUMENTS 3,255,907 A * 6/1966 Eddy ..... 215/329
3,879,492 A 4/1975 Bontinick
4,013,188 A * 3/1977 Ray ..... 215/347
4,280,653 A 7/1981 Elias
4,358,919 A 11/1982 Hirota et al.
4,392,579 A 7/1983 Uhlig et al.
4,527,705 A * 7/1985 Prades ..... 215/252
4,625,875 A 12/1986 Carr et al.
4,638,913 A 1/1987 Howe, Jr.
4,705,188 A 11/1987 Rahn
4,722,447 A 2/1988 Crisci
4,842,951 A 6/1989 Yamada et al.
4,881,649 A 11/1989 Hsu et al.
4,894,266 A 1/1990 Bauer et al.
4,896,783 A 1/1990 Leoncavallo et al.
5,002,811 A 3/1991 Bauer et al.

(Continued)

FOREIGN PATENT DOCUMENTS

WO WO 90/099335 9/1990

*Primary Examiner*—Robin A. Hylton
(74) *Attorney, Agent, or Firm*—James E. Cole; Middleton Reutlinger

(57) ABSTRACT

The present development is for a closure which provides a means for maintaining an effective pressure against a peelable seal affixed to a container lip as the sealed container is exposed to relatively high temperature and pressure conditions. The closure includes a liner which abuts a surface of the seal so as to sandwich the seal between the liner and the container lip. The resilient liner and inner foil seal are positioned above a retaining structure and function such that the peelable seal will not rotate relative to a container rim upon engaging the container rim as the closure is rotationally applied. This functions to inhibit torque transmission from the closure to the inner seal or reseal structure and further inhibits imperfections in the container rim from scraping or otherwise damaging the inner seal.

20 Claims, 11 Drawing Sheets

U.S. PATENT DOCUMENTS 5,006,384 A 4/1991 Genske
5,011,719 A 4/1991 Gehrke et al.
5,023,121 A 6/1991 Pockat et al.
5,061,532 A 10/1991 Yamada
5,069,355 A 12/1991 Matuszak
5,071,686 A 12/1991 Genske et al.
5,092,469 A 3/1992 Takata et al.
5,093,164 A 3/1992 Bauer et al.
5,110,642 A 5/1992 Genske
5,151,317 A 9/1992 Bothe
5,160,767 A 11/1992 Genske et al.
5,175,035 A 12/1992 Pinsolle et al.
5,178,293 A 1/1993 Suzuki et al.
5,302,442 A 4/1994 O'Brien et al.
5,447,792 A 9/1995 Brandt et al.
5,492,757 A 2/1996 Schuhmann et al.
5,500,265 A 3/1996 Ambroise et al.
5,533,622 A 7/1996 Stockley, III et al.
5,626,929 A 5/1997 Stevenson
5,702,015 A * 12/1997 Giles et al. ..... 215/232
5,756,178 A * 5/1998 Obadia ..... 428/66.4
5,773,136 A 6/1998 Alder et al.
5,785,195 A 7/1998 Zwemer et al.
5,837,369 A 11/1998 Grunberger et al.
5,851,640 A 12/1998 Schuhmann et al.
5,882,789 A 3/1999 Jones et al.
5,929,128 A * 7/1999 Whetten et al. ..... 521/85
5,973,077 A 10/1999 Kan et al.
5,992,661 A 11/1999 Zumbuhl
5,997,968 A 12/1999 Dries et al.
6,202,871 B1 3/2001 Kelly
6,231,975 B1 5/2001 Kong et al.
6,235,822 B1 5/2001 Whetten et al.
6,265,083 B1 7/2001 Tanizaki et al.
6,276,543 B1 8/2001 German et al.
6,659,297 B2 12/2003 Gregory et al.
6,902,075 B2 * 6/2005 O'Brien et al. ..... 215/232
2002/0162818 A1 11/2002 Williams

* cited by examiner

CLOSURE FOR A RETORT PROCESSED CONTAINER HAVING A PEELABLE SEAL

CROSS-REFERENCE TO PRIOR APPLICATIONS

This application is a continuation-in-part of and claims priority to U.S. patent application Ser. No. 10/026,161, filed on Dec. 21, 2001, currently pending, which is incorporated by reference.

BACKGROUND OF THE INVENTION

The present invention relates to a closure for a closure-container combination having a peelable seal and that is sterilized using a retort process. The closure causes the seal to maintain a positive pressure against a container lip as the container undergoes sterilization by retort processing thereby minimizing the risk of leakage under the seal.

In recent years, packaged products which are room temperature storage stable yet ready-to-use upon opening, i.e. they require no cooking or heating before use, have become extremely popular with the consumer. For many food products, this trend requires only minor packaging changes, such as modifying the package size to be consistent with the anticipated consumer use pattern. However, for products prone to bacterial contamination and spoilage, such as milk-based beverages, soups, and many other low acid food products, this trend presents some major packaging challenges.

For example, milk-based and low acid food products need to be sterilized to reduce the initial viable bacterial concentration in a product, thereby reducing the rate at which the product will spoil and lengthening the product's shelf-life. One procedure for reducing the viable bacterial concentration is sterilization by retort processing. In the retort process, a chilled or ambient temperature product is poured into a container and the container is sealed. The container may be sealed by melding two sections of the container material together, such as by heat-sealing a seam on a pouch, or the container may be sealed by bonding a seal to the lip of the container, such as by induction sealing a foil-lined seal to a barrier polymer material bottle neck. The filled package is then sterilized at high temperature in a high pressure water bath. In a typical commercial production rate retort process, the package is heated from an ambient temperature of about 75° F. to a sterilizing temperature in the range of from about 212° F. to about 270° F. As the exterior surface of the package is heated, the package contents are heated and the internal (vapor) pressure increases. By concurrently, submerging the package in the water bath, a counteracting external pressure increase is applied to the container. Although the retort process is an efficient sterilization process, it is harsh on packaging materials because of the temperature and pressure variations involved. Materials commonly used for stand-up, reclosable containers, such as plastic bottles, tend to soften and distort during retort processing. Materials used for seals can soften and, because the seal material is distinct from the container material, can form small gaps or pinholes at the bond interface. These gaps or pinholes can allow product to vent out of the container as the internal pressure increases during the retort process and can allow process bath water to enter the container as the internal pressure decreases relative to the external pressure and the package returns to ambient conditions. Because the packaged beverage and the process water may pass through very small gaps at the bond interface, this event may occur even though the product appears to have an acceptable seal. Moreover, the container and seal may enter the retort process in a less than ideal condition because the process to adhere the seal to the container can cause the neck, the lip, the threads or a combination thereof on the container to distort slightly. If the seal is transferred to the neck with a closure mounted on the container, the skirt, top, threads or a combination thereof on the closure may distort during the seal transfer process. These material failures can increase the number of manufacturing errors and can allow for product contamination even on packages that appear to meet quality standards.

Barrier pouches minimize the risk of material failures during retort processing because the pouch usually has sufficient flexibility that it can alter its shape in response to the over-pressure conditions of the retort process. Moreover, barrier pouches generally have minimal headspace within the sealed pouch so the packages are less affected by the external pressure changes than are packages with relative large headspaces, such as semi-rigid bottle-like containers. Further, the seals or bonds are created by melding the pouch material to itself thereby creating strong, non-distinct bonds. Hence, well-sealed packages which are not dependent on maintaining their original shape can be produced. However, the pouches usually require specialized devices, such as sharp-tipped straws, to open the package and do not allow the consumer to reclose the package after opening.

For bottles or similar stand-up containers that are sealed such that the seal can withstand the retort process, a different problem may be created. The seal may adhere so tightly to the container lip that when the consumer attempts to remove the seal, the seal may be very difficult to remove from the container, and/or may tear into small pieces and leave fragments along the container rim. If the product is a beverage or similar liquid product, the product may settle under the seal fragments as the beverage is dispensed. This can make the product aesthetically unacceptable and unpleasant for repeated use by the consumer and increase the probability of bacterial contamination under the seal fragments. Further, the user risks being cut or scratched by the remaining foil bits along the container lip. Semi-rigid containers also have relatively large headspaces thereby allowing the user to shake and remix the product immediately before dispensing. However, during retort processing, the air-filled headspace will be affected more rapidly than the liquid product by the temperature changes increasing the pressure against the seal and thereby increasing the probability of seal failure.

SUMMARY OF THE INVENTION

The present invention is for a closure for a container that has a peelable seal wherein the sealed container is sterilized using a retort process. The closure provides a means for maintaining an effective pressure against the seal to prevent seal separation or leakage as the sealed container is subjected to the temperature and pressure deviations of the retort process.

Specifically, the closure includes a resilient liner and a skirt with at least one thread affixed to the skirt interior surface. The liner fits firmly within the closure, defines a resting thickness "t" at ambient temperature and pressure conditions, and is made from a material capable of being compressed to a thickness less than the resting thickness "t" and of recovering to a thickness sufficient to maintain an effective pressure between the closure and the peelable seal affixed to the container. In an embodiment of the present invention, the liner is made from a material capable of being compressed to a thickness less than the resting thickness "t" and of recovering to a thickness not greater than the resting thickness "t". In an alternative embodiment of the present invention, the liner is made from a material capable of being compressed to a thickness less than the resting thickness "t" and of recovering to a thickness which may be greater than the resting thickness "t". Also, in an embodiment of the present invention, the thread defines an angle θ between the upper edge and a horizontal plane and the angle θ is less than about 45°.

More specifically, the closure includes a top wall and an annular skirt depending from said top wall, a retaining structure extending radially inward from an inner surface of the annular skirt, a reseal structure or layer disposed above the retaining structure and adjacent the top wall of the closure wherein the reseal structure may have at least one slip layer on an upper surface, a lower surface, or both. The closure further comprises an inner seal positioned above the retaining structure abutting a lower surface of said reseal structure. The reseal structure may be formed of rubber and synthetic olefin rubber and the slip layer may be formed of a smooth, low friction polymeric material such as polypropylene. The retaining structure may be a bead, continuous or interrupted. The slip layer may further include a lubricant or the reseal structure may be integral with the closure and the closure may comprise a lubricant.

DETAILED DESCRIPTION OF THE INVENTION

The present invention is for a closure for a container that has a peelable seal wherein the sealed container is sterilized using a retort process. The closure provides a means for maintaining an effective pressure against the seal to prevent seal separation or leakage as the sealed container is subjected to the temperature and pressure deviations of the retort process. The closure and container depicted in the various Figures is selected solely for the purpose of illustrating the invention. Other and different closures, containers, or combinations thereof, may utilize the inventive features described herein as well.

Figure 1:
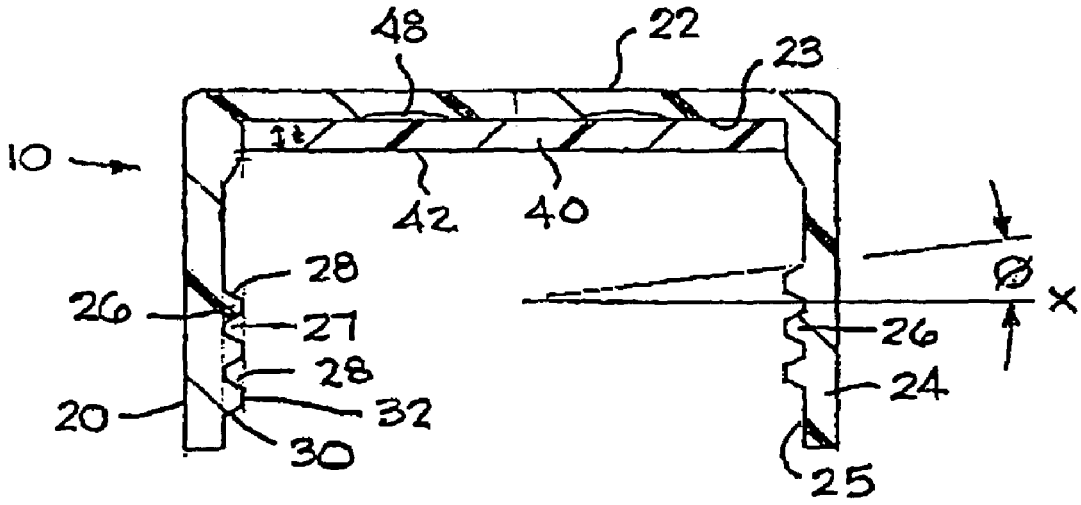
FIG. 1 is a sectional view of a closure made in accordance with the present invention.

Reference is first made to FIGS. 1–4 in which a closure constructed in accordance with the present invention is generally noted by the character numeral 10. The closure 10 includes a cap 20 and a liner 40. As generally shown in FIG. 1, the cap 20 includes a top 22, a skirt 24 depending from the top 22, and at least one thread 26. The top 22 and skirt 24 have interior surfaces 23 and 25, respectively. The thread 26 is affixed to the interior surface 25 of the skirt 24, circumscribing the skirt 24 in a spiral such that a depression or thread receiving groove 27 is formed. The thread 26 defines an upper edge 28, a lower edge 30 and a face 32. As is known in the art, the upper edge 28 and lower edge 30 are angled from a horizontal plane "X" causing the thread 26 to have beveled edges rather than sharp corners at the face 32, and allowing the thread 26 to be optimized for strength, cooling and material usage. In the closure 10 of the present invention, the angle for the upper edge 28 is preferably relatively close to horizontal. For example, an angle θ defined between the horizontal plane X and the upper edge 28 is not greater than about 45°, and preferably is less than about 20°. In the embodiment shown, the angle θ is about 10°.

Figure 4:
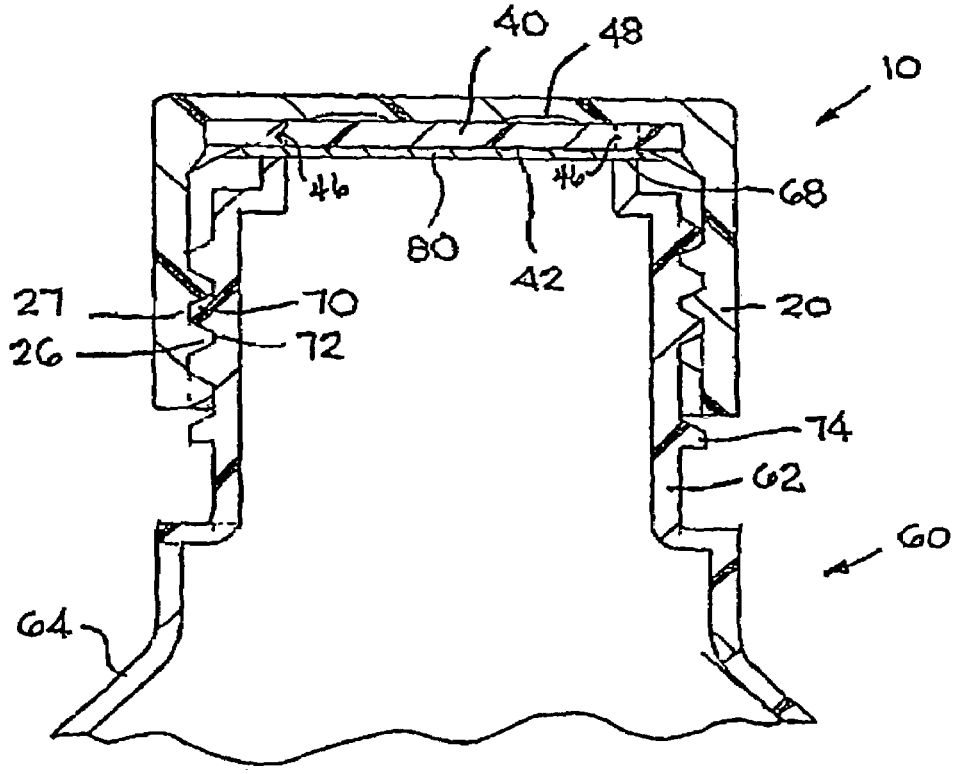
FIG. 4 is a sectional view of the closure of FIG. 1 shown with the container of FIG. 2 in a normal fully inserted position.

The liner 40 abuts the top interior surface 23 of the cap 20 and is sized to fit firmly within the cap 20, i.e., the diameter of the liner 40 is large enough that the liner 40 can be held within the cap 20 by the thread 26 without the need for a bonding material. Optionally, as shown in FIGS. 1 and 4, the liner 40 may be adhered to the top surface 23 by a variety of means known in the art, such as with a thin layer of adhesive, thermoplastic polymeric material, glue or similar bonding material 48. Combinations of bonding material layers may be used as desired by the user. The liner 40 defines a resting thickness, "t", which is the unrestrained thickness of the liner 40 at ambient temperature and pressure conditions. The material selected for the liner 40 should be sufficiently pliable or elastic that the liner 40 can be compressed between the cap 20 and a container 60, thereby decreasing the liner thickness "t". But, the liner 40 material should also be sufficiently resilient that the material can recover from the compressed state to define a recovery thickness, "$t_r$", at ambient temperature and pressure conditions or under stress temperature and pressure conditions, such as are present during a retort process. The recovered thickness of the liner 40, $t_r$, may be essentially equal to, less than, or greater than the resting thickness, t. The recovery thickness, $t_r$, should be sufficient to allow the liner 40 to maintain a positive pressure against the cap 20 and a seal 80 affixed to a container lip 68, wherein the pressure is adequate to prevent the seal 80 from separating from the container 60. To maintain the pressure against the seal 80, the liner 40 should have sufficient elasticity that it can conform to any distortions in the container lip 68, such as molding nubs or small divots or voids. For example, the liner 40 may be made from a thermoplastic or a thermoset material such as a silicone-based material, urethane, latex, rubber, a thermoplastic elastomeric material such as Santoprene®, or a combination thereof. Optionally, the liner 40 may be made from a material having a melting point greater than the anticipated maximum retort processing temperature, such as about 265° F., and having a shore A value of about 70. To enhance the expansion capabilities of the material, the liner 40 material may also include foaming agents, entrapped or encapsulated gases or similar expanding agents. Because the liner 40 is in direct contact with the seal 80, the materials selected for the liner 40 should not bond to the seal 80.

Figure 2:
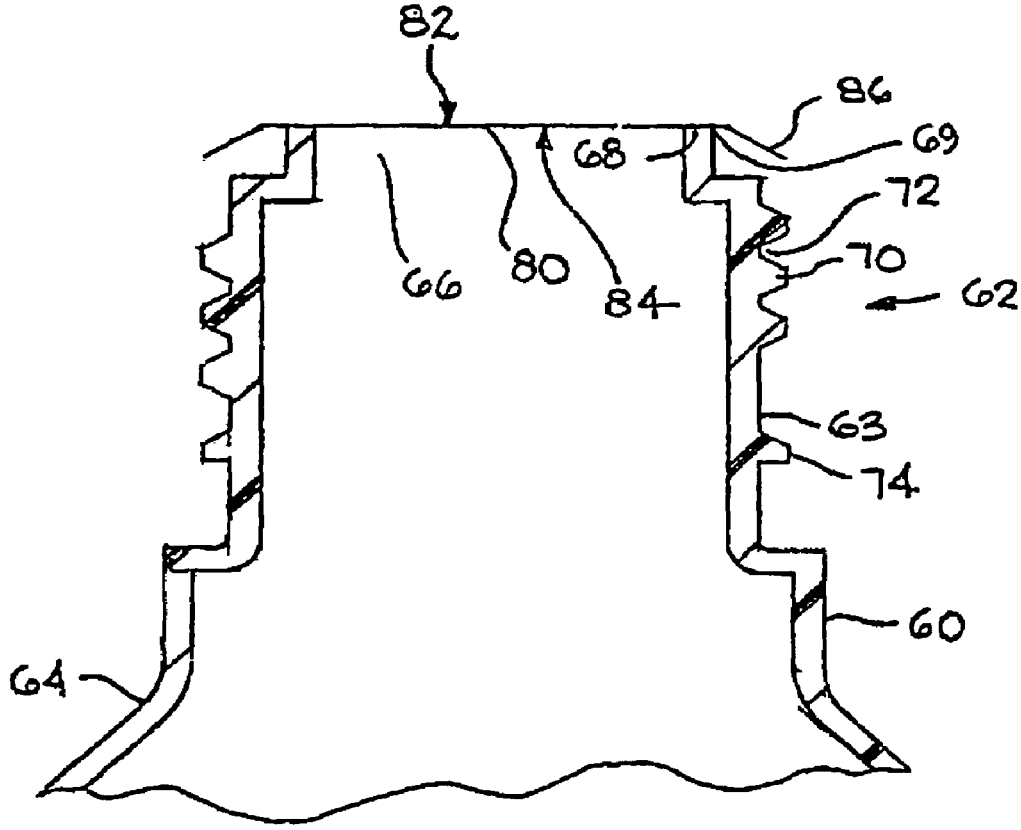
FIG. 2 is a sectional view of a container with a seal amenable for use with the closure of FIG. 1.
Figure 3:
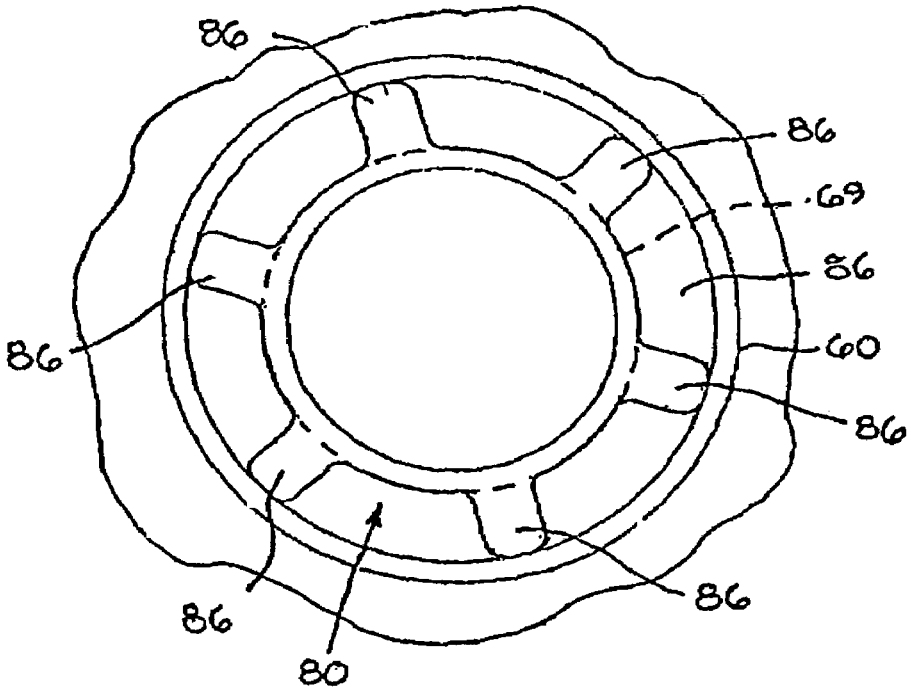
FIG. 3 is a top view of the container of FIG. 2 with a seal on top.

The closure 10 is designed to function cooperatively with the container 60 having the removable seal 80. As shown in FIGS. 2–4, the container 60 has a neck 62 which extends vertically from shoulders 64 and terminates in an opening 66, defining the lip 68 having a periphery 69. As shown in FIGS. 2 and 3, the neck 62 has an exterior face 63 adapted to allow the container 60 to receive and engage the cap 20. The engaging face 63 includes a container thread 70 fixedly attached to the engaging face 63, and a thread receiving groove 72. The thread 70 may have one of a variety of thread configurations, such as a single helix (1 strand), a double helix (2 strands), a triple helix (3 strands) or other multiple helices, as are known in the art. Optionally, the neck 62 may include a bottle bead or collar 74. The bottle bead 74 is an annular projection located near the shoulder portion 64 of the container 60 and encircling the neck 62. The bottle bead or collar 74 may be a continuous bead or it may be interrupted allowing for drainage of retort bath water. The container 60 may be manufactured from a variety of materials as are known in the art for container use. Preferably, the container 60 is made of a rigid or semi-rigid polymeric material which can withstand retort processing conditions.

The seal 80 has a top face 82 and a container face 84. The seal 80 is reversibly affixed to the container lip 68, and preferably, is affixed to the lip 68 such that the seal 80 can be completely removed from the lip 68 by the user without tearing, shredding or leaving consumer noticeable fragments on the container lip 68. As is known in the art, the seal 80 may be proportioned to match the periphery 69 of the container neck 62, or it may be proportioned to extend beyond the periphery 69 thereby partially covering the exterior face of the neck 62, or it may be proportioned to match the periphery 69 in some sections and to extend beyond the periphery 69 at other sections, such as by including one or more tabs 86. The seal 80 preferably has sufficient strength and elasticity to allow the seal 80 to conform to the container lip 68 while accommodating any distortions, such as molding nubs or small voids or divots, and to expand and contract in the retort process without rupturing. Further, the seal 80 preferably can be adhered to the container lip 68 to form a semi-permanent bond between the seal 80 and container 60.

In the embodiment shown in FIGS. 1 and 4, the closure 10 is reversibly attached to the container 60 after the container 60 is filled and has the seal 80 affixed to the container lip 68. The container contents are then sterilized with retort processing. In a typical process, the filled package is transported through a high pressure overheated water bath, wherein the package is heated to from about 75° F. to about 265° F. for a predetermined period of time. As the exterior surface of the package is heated, the package contents are heated and the internal (vapor) pressure increases. Concurrently, the package is submerged to greater depths in the water bath resulting in a counteracting external pressure increase. The package is then slowly raised—moved to a more shallow depth—as the package is concurrently transported into a cooler zone in the water bath. The rate of movement into the cooler zone and shallower depth is designed to minimize variations in the internal pressure of the package. After a predetermined time, the package is removed from the water bath and allowed to cool to room temperature.

As shown in FIG. 4, the closure 10 functions cooperatively with the container 60 and seal 80 to provide an added measure of protection for the seal integrity as the container contents are sterilized by the retort process. Specifically, the closure 10 fits over the container neck 62 and the cap thread 26 complements the container thread 70 with the cap thread 26 fitting within the container receiving groove 72 and the container thread 70 fitting within the cap receiving groove 27. Further, the cap 20 and the liner 40 are proportioned such that when the container 60 is fully inserted in the closure 10, a bottom face 42 of the liner abuts the seal 80. In the embodiment shown in the Figures, the cap thread 26 and the container thread 70 are single helices, but any complementary thread design may be used provided the thread design can withstand the processing conditions.

During the retort process, the liner 40 functions cooperatively with the cap 20 to provide a pressure against the seal 80 opposing the container lip 68. Specifically, when the closure 10 is attached to the sealed container 60 at ambient temperature and pressure conditions, the cap 20 may be tightened on the container 60 such that the liner 40 is compressed slightly between the container lip 68 and the top interior surface 23 of the cap 20. A sealing zone 46, shown in FIG. 4, is thereby formed where the seal 80 and liner 40 are sandwiched between the cap 20 and the container lip 68. When the closure 10 and sealed container 60 are exposed to the retort conditions, the seal integrity is challenged by pressure increases within the container 60. With the liner 40 pressing the seal 80 against the container lip 68, the probability of the seal 80 separating from the container lip 68 as the pressure changes within the container 60 is minimized. Further, when the closure 10 and sealed container 60 are exposed to the high pressure retort conditions, small droplets of water from steam or the water bath may attempt to migrate into any void spaces that are present between the container 60 and the closure 10 because of the increased pressure outside the container 60. By forming a tight barrier between the top interior surface 23 of the cap 20 and the top face 82 of the seal, the liner 40 can minimize the risk of water droplets migrating between the cap 20 and the seal 80.

During the retort process, the angle θ of the cap and closure threads 26, 70 functions to hold the closure 10 on the container 60. Because of the pressure changes in the container associated with the retort process, the container may be distorted, and the distortion can affect the interaction of the container threads 70 with the cap threads 26. Threads with an essentially horizontal angle θ are stronger than threads having a larger angle θ. As the thread strength increases, the probability of the threads stripping and loosening decreases. Thus, because the threads of the closure 10 have a relatively small angle θ, the closure 10 is held securely on the container 60 and the liner 40 is held against the seal 80.

The closure 10 may remain on the container 60 until removed by the consumer. Optionally, the closure 10 may be removed from the container 60, the exterior surface of the neck 63 may be dried, for example with heated air, and a commercial closure may be applied. The commercial closure may be essentially identical to the closure 10, it may include tamper-evident features, or it may include other consumer-desired or aesthetic features, as are known in the art. However, small droplets of water can migrate under pressure from the water-bath into any void spaces that are present between the container 60 and the closure 10 during the retort process. Thus, if the closure 10 is to remain on the container 60 after processing, the closure 10 is preferably adapted to allow water to drain from spaces between the closure 10 and the container 60.

Figure 5:
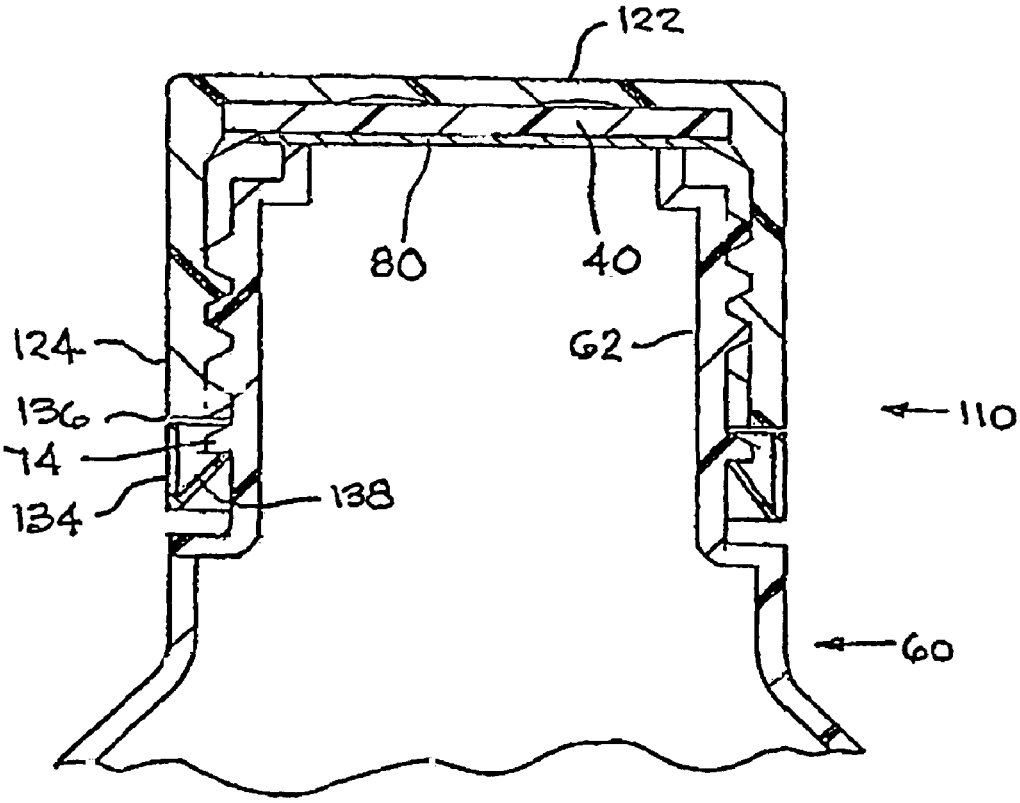
FIG. 5 is a sectional view of an alternative embodiment of a closure made in accordance with the present invention having a plurality of folding fingers as the engaging means for the tamper-evident band.
Figure 6:
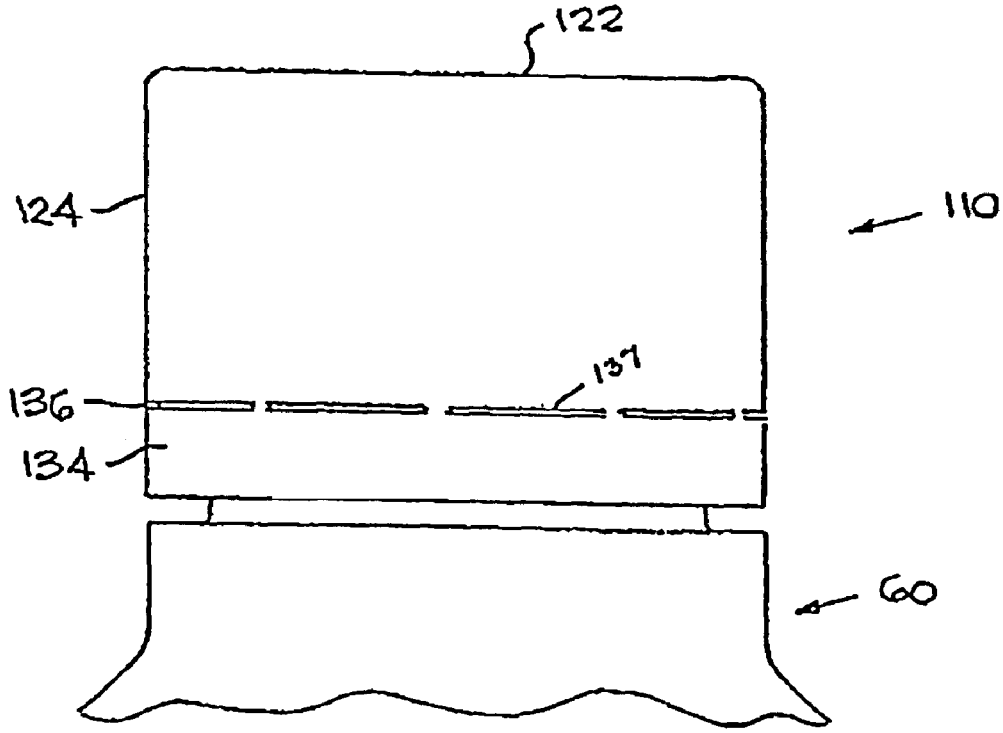
FIG. 6 is a side view of the closure of FIG. 5.

As shown in FIGS. 5 and 6, an alternative embodiment of the closure 110 is intended to be attached to the container 60 before retort processing and to remain on the container 60 until removed by the consumer. The closure 110 is essentially identical to the closure 10 except that a skirt 124, depending from a top 122, terminates with an essentially circular tamper-evident band 134. The tamper-evident band 134 can be similar to any known tamper-evident or child-resistant band provided the band includes some void areas which would allow water droplets to drain from the band. In the embodiment shown, the tamper-evident band 134 includes a break-away section 136 and a means 138, such as flexible finger projections, for positively engaging the collar 74. As is known in the art, the flexible finger projections include spaces between the fingers which allow any trapped water to drain from the band 134. In addition, some water drainage may be provided through apertures 137 in the break-away section 136.

Figure 7:
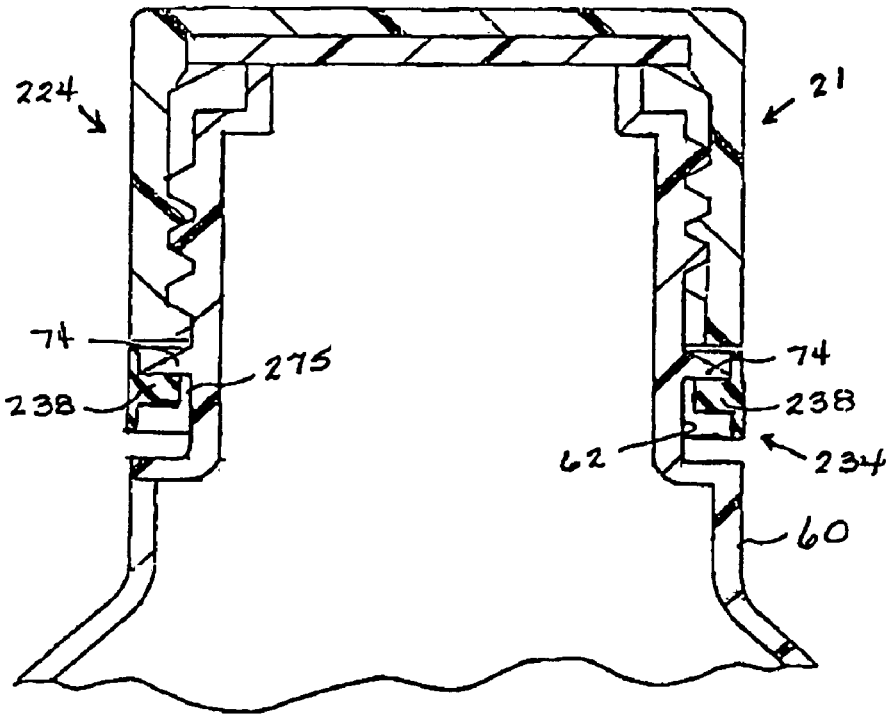
FIG. 7 is a sectional view of a second alternative embodiment of a closure made in accordance with the present invention and having a continuous band as the engaging means for the tamper-evident band.
Figure 7A:
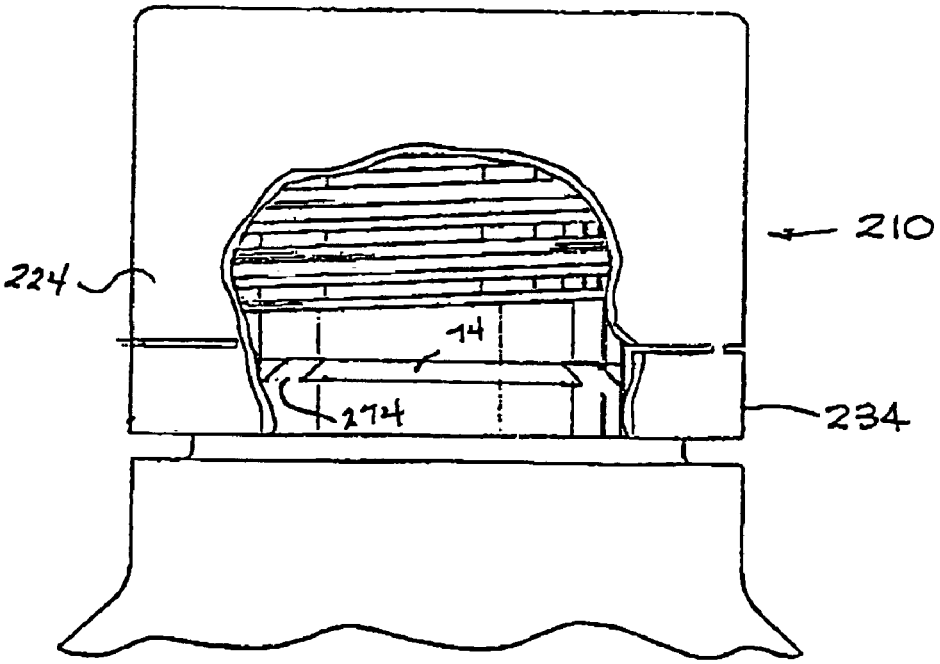
FIG. 7A is a cut-away view of the closure of FIG. 7 showing the segmented bottle bead.

A second alternative embodiment 210 of a closure with a tamper-evident band 234 is shown in FIGS. 7 and 7A. The closure 210 is similar to the closure 110 of FIG. 5 except that the means for positively engaging the collar 74 is a bead 238 encircling the skirt 224. The bead 238 has an internal diameter slightly greater than the external diameter of the exterior surface of the container neck 63 so that a gap 275 remains between the bead 238 and the neck exterior surface 63. Additionally, optional gaps or breaks 274 are preferably included in the container collar 74 to allow water droplets to drain from band 234 and to improve the air circulation between the skirt 224, band 234 and the container neck 62.

Figure 8:
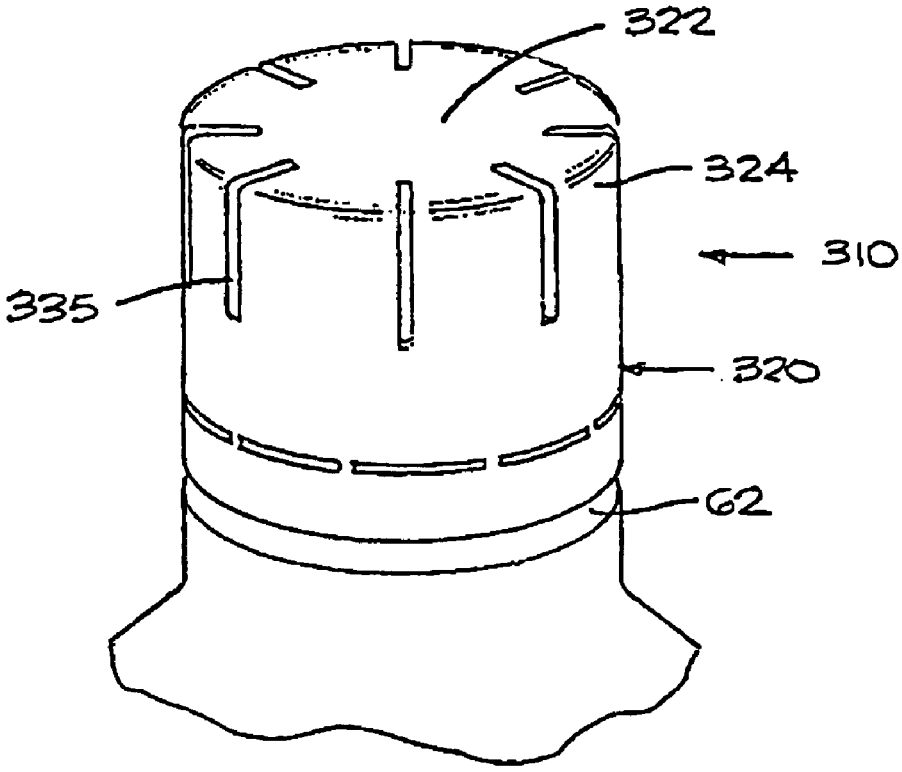
FIG. 8 is a side view of the closure of FIG. 5 having a slotted skirt.

FIG. 8 shows a third alternative embodiment of the closure 310 which allows for air circulation between the container neck 62 and the cap skirt 324. The closure 310 of FIG. 8 is identical to the closure 110 of FIG. 5 except that ventilation slits 335 have been added to the cap 320 running a predetermined length from the top 322 to the skirt 324. The slits 335 may extend a slight distance onto the top 322 but may not breach the sealing zone 46. The slits 335 allow air to circulate between the container neck 62 and the skirt 324. The number and precise positioning of the slits can vary as necessary for the particular container/closure combination.

Figure 9:
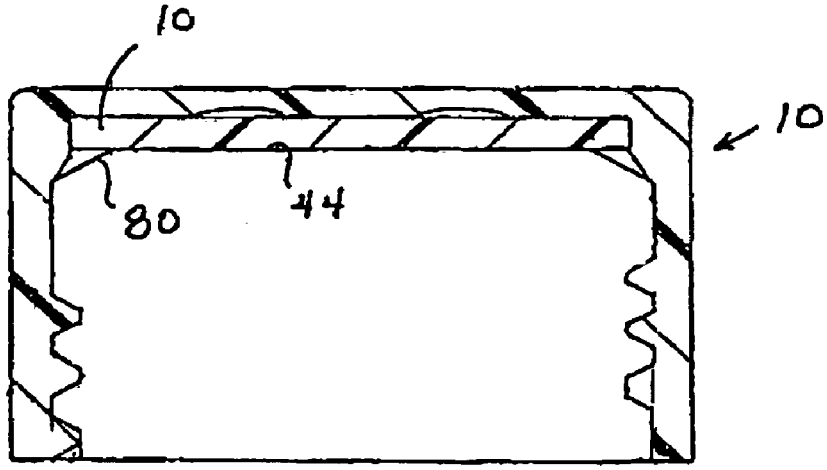
FIG. 9 is a sectional view of the closure of FIG. 1 shown with a seal affixed to the liner.

As described in the embodiments of FIGS. 1–8, the seal 80 is secured to the container lip 68 before the closure 10 is affixed to the container 60. However, as shown in FIG. 9, the seal 80 may be delivered to the container 60 via the closure 10. For example, the seal 80 may be included as a transferable part of the liner 40, wherein the seal 80 is reversibly secured to a bottom face 44 of the liner 40. Using the embodiment of FIG. 9, the closure 10 may be reversibly attached to the container 60 such that the seal 80 abuts the container lip 68. The seal 80 can then be secured to the container lip 68 and released from the liner 40 using known heat-sealing techniques, such as induction heat sealing or conduction heat sealing. After the seal 80 has been affixed to the container lip 68, the closure 10 can be removed from the container 60 with the liner 40 remaining in the closure cap 20 and the seal 80 remaining on the container 60. The seal 80 is preferably transferred from the liner 40 to the container lip 68 before the container 60 is subjected to the retort processing conditions. The retort process then proceeds as described for the embodiment shown in FIGS. 1–4.

Figure 10:
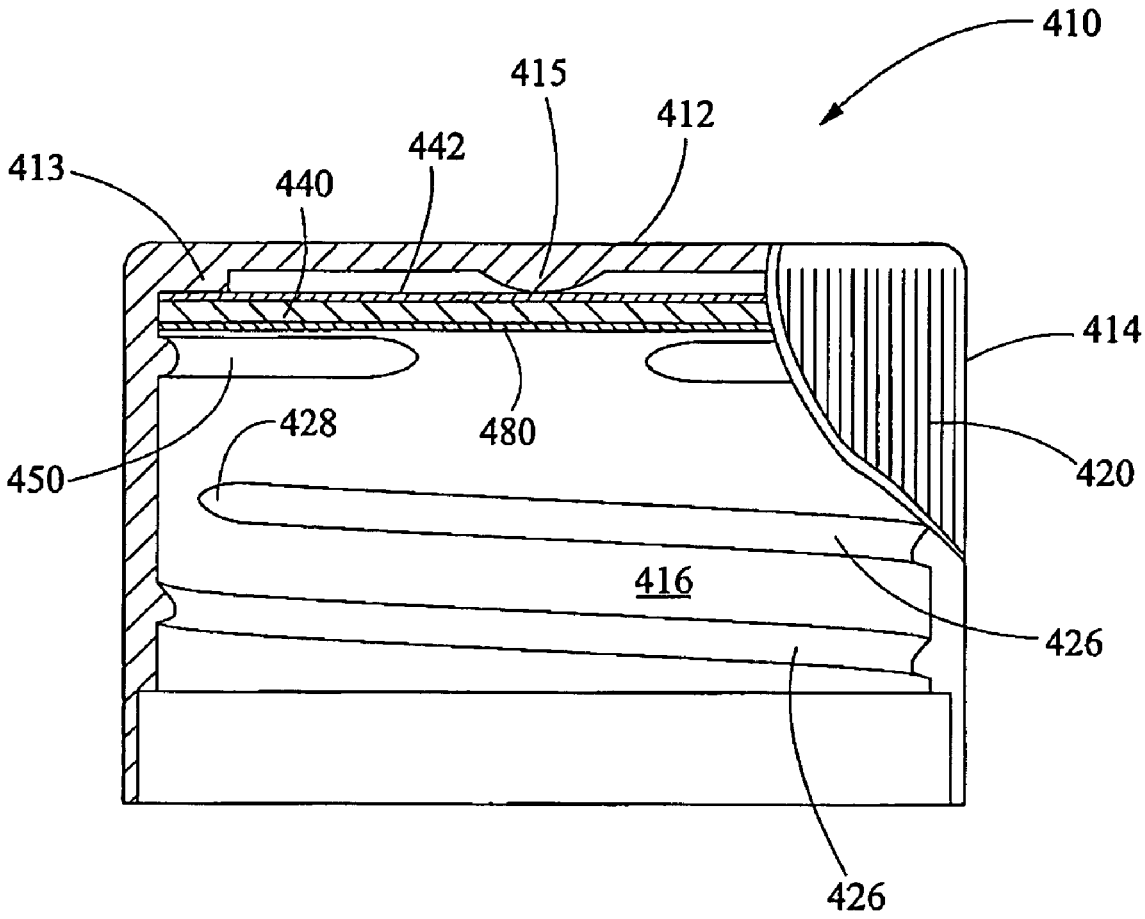
FIG. 10 is a sectional view of one embodiment of a closure of the present invention with a portion of the sidewall in view.
Figure 11:
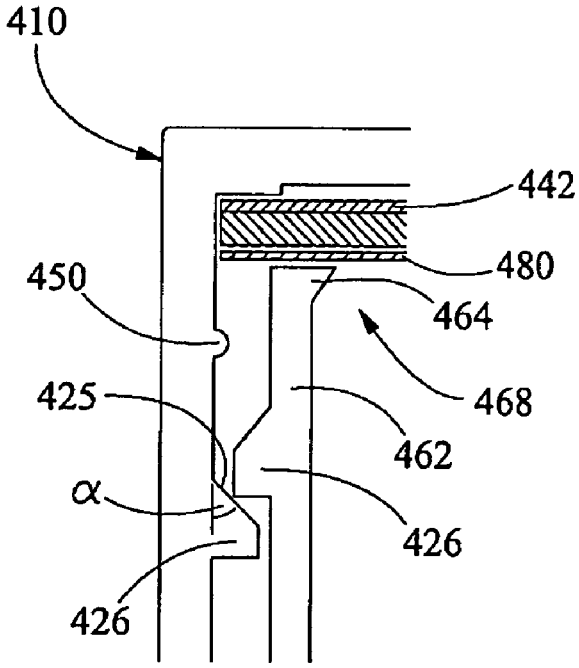
FIG. 11 is a side sectional view of the closure of FIG. 10 engaging a container neck.

Referring now to FIG. 10, an alternative closure 410 is shown in a sectional view. The closure 410 is formed of a polymeric material, as previously described, including but not limited to polypropylene which is capable of withstanding the thermal sterilization or retort process previously described. The closure 410 has a top wall 412 including upper and lower surfaces and an annular skirt 414 depending from a peripheral edge of the top wall 412. The lower or inner surface of the top wall 412 includes a stepped portion 413 circumferentially extending near the peripheral edge of the top wall 412 and has a gate well 415 having a substantially domed shape depending from the closure top wall 412. The stepped portion of the top wall 413 serves to reduce surface area contact between a reseal layer 440 or slip layer 442 and the top wall 412 and allowing a place for reduced contact pressure between the reseal layer 440 and the gate well 415 and any other inscriptions for instance mold cavity or identifications present on the top wall 412 consequently reducing friction therebetween and more importantly inhibiting torque transmission from the closure 410 to a reseal layer 440 and inner seal 480. The annular skirt 414 has an inner surface 416 and an outer surface. The outer surface of the skirt 414 may have a plurality of knurlings 420 to aid a user in gripping and applying torque to the closure. Extending from an inner surface of the annular skirt 414 may be a retaining structure 450 which functions to retain the reseal layer 440 and an inner seal 480. The retaining structure 450 may be a continuous bead extending about the inner surface 416 of the annular skirt 414 or an interrupted bead as shown in FIG. 10 which also serves to allow for drainage of process fluids. Additionally, one of ordinary skill in the art may also realize that the retaining structure 450 may be defined by a top portion of a thread helically extending along the inner surface of the annular skirt 414. As seen in FIG. 10, the inner surface of the annular skirt 416 of the present embodiment includes a retaining structure 450 and a separate and distinct thread 426. As shown in FIGS. 10 and 11, the thread 426 is a jumped thread design meaning the closure 410 may be removed from a mold core by linear force rather than rotatably removing the closure 410 from the mold core. The jumped thread does not helically extend to the top wall of the closure 410, but instead has an end point 428 a preselected distance beneath the closure top wall 412 and beneath the retaining structure 450. This design is advantageous since it allows a space for the overhanging portion of an inner seal 480 described below. The jumped thread profile has a driving face or upper surface 425 disposed at an angle α from the inner skirt surface 416 allowing removal from a mold core by a linear force rather than rotation. The angle α may be between about 30 and 55 degrees and as exemplary of one embodiment the angle α is about 45 degrees.

Referring again to FIG. 10, the retaining structure 450 may be an interrupted bead design extending about the inner skirt surface 416 of the closure 410 above the thread 426. Above the retaining structure 450 is an inner seal 480 preferably formed of foil, which may include aluminum. The foil inner seal 480 is preferably round in shape having a diameter which is larger than the diameter of the retaining structure 450. It is desirable that when the closure 410 is rotationally applied to a container neck, the inner seal 480 not rotate relative to the container rim since the inner seal may be scrubbed, twisted or otherwise damaged by imperfections in or friction with the container neck finish 462 of FIGS. 11–12, particularly in high-torque applications used in sterilized process applications which may require more severe extremes than non-sterilized process applications. In this first configuration the retaining structure 450 retains the inner seal 480 without the use of glue and allows the inner seal to rotate above the retaining structure 450, relative to the closure 410, inhibiting damaging torque application to the foil inner seal 480. The foil seal 480 also has a diameter slightly larger than the diameter of the container mouth 468 shown in FIGS. 11, 13, and 14 providing at least two advantages. First, an overhanging portion of the inner seal 480 extending about the container neck 462 aids the user in removal of the inner seal 480 upon opening of the container. Second, the overhanging portion allows for removal of tabs from the edges of the inner foil seal 480. Through experimentation it was found that during induction heating of the inner seal 480, tabs, such as those previously described and positioned about the circumference of the inner seal 480, absorb excessive amounts of heat causing inconsistent sealing between the tabs along the mouth of the container 468. Removal of the tabs therefore results in proper sealing of the inner seal 480 along the container rim.

Referring again to FIG. 10, above the inner seal 480 is the reseal layer or resilient liner 440, having a substantially circular shape formed of a soft, flexible, rubbery and tacky material. In one exemplary embodiment, the reseal layer or reseal structure 440 may be formed of a rubber and synthetic olefin rubber material having good sealing characteristics. The reseal layer 440 is substantially circular in shape having a diameter which is larger than the inside diameter of the retaining mechanism 450 thus retaining the reseal layer 440 there above. The diameter of the reseal layer 440 should also be small enough that if high torque is placed on the closure 410 and the reseal layer 440 extrudes outward as it is compressed, the reseal layer 440 does not interfere with the inner skirt surface 416 and damage the reseal layer 440. The reseal layer 440 must also withstand temperatures and pressures associated with thermal sterilization or retort process. The reseal layer 440 preferably has a thickness which may compensate for any uneven pressure applied to the reseal layer 440 due to the angle $\alpha$ of the driving face during application of closure 410 to a container neck. Such pressure may be applied when the reseal layer 440 compresses as it reaches the container rim 468.

Figure 15:
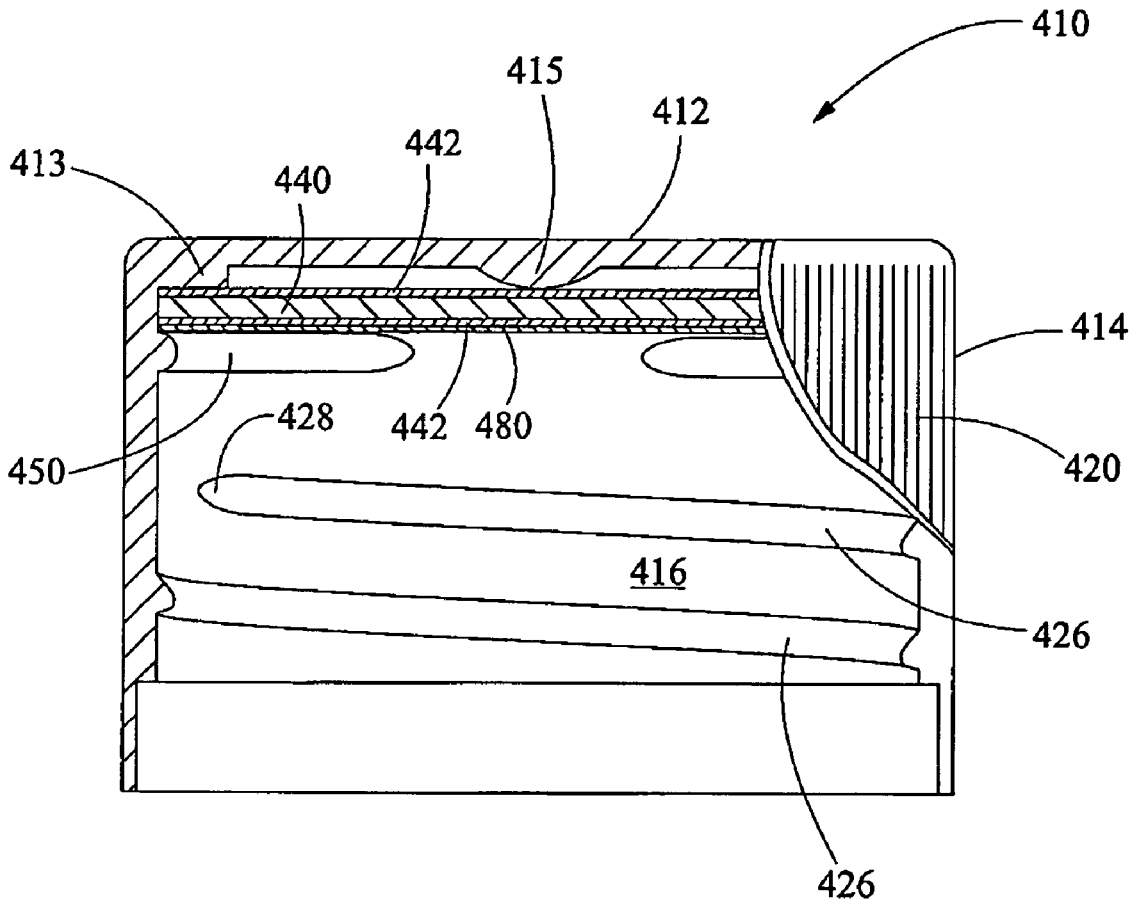
FIG. 15 is a side view of the closure of FIG. 10 having an alternative slip layer design.
Figure 16:
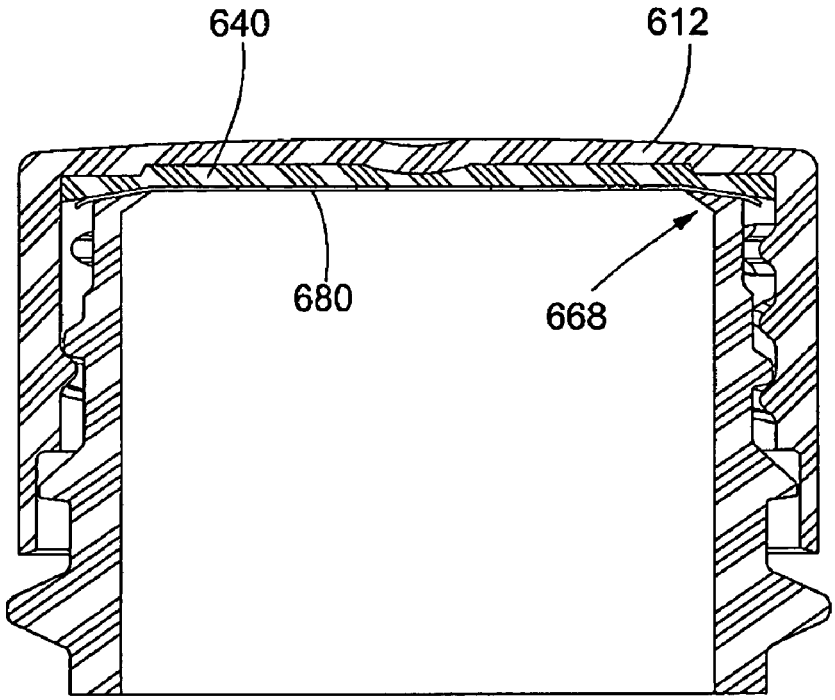
FIG. 16 is a sectional view of the closure of FIG. 10 having a reseal liner integral with the top wall of the closure.
Figure 17:
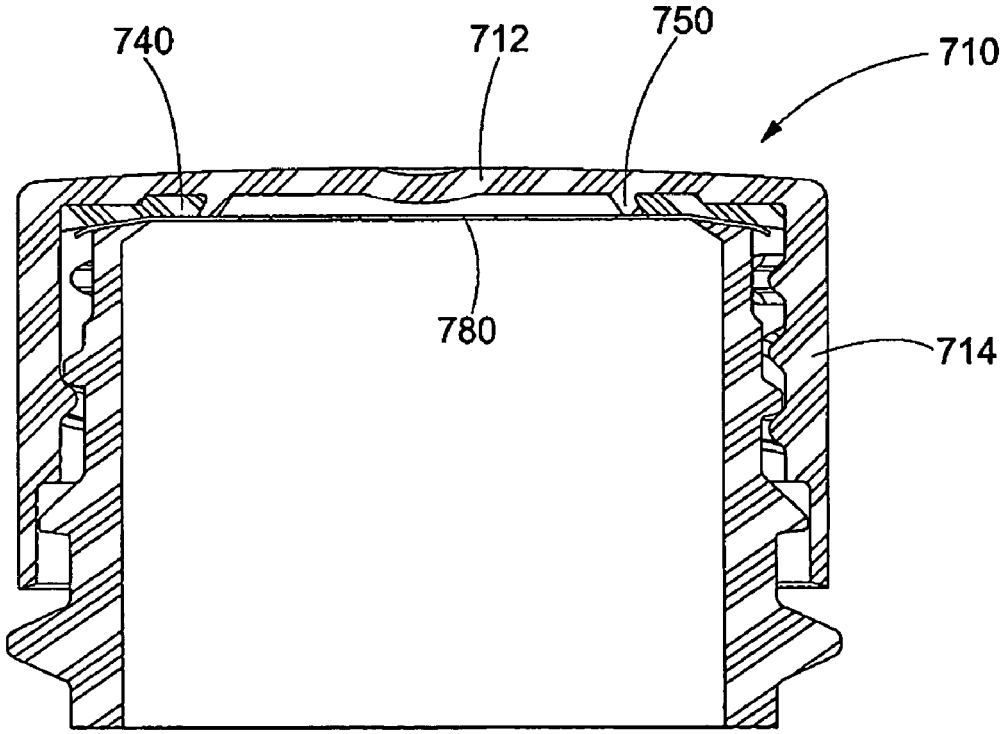
FIG. 17 is a sectional view of the closure of FIG. 16 having an alternative reseal liner feature integral with the top wall of the closure; and, FIG. 18 is a sectional view of an alternative closure of FIG. 10 having a crab claw liner feature in combination with a foil seal.
Figure 18:
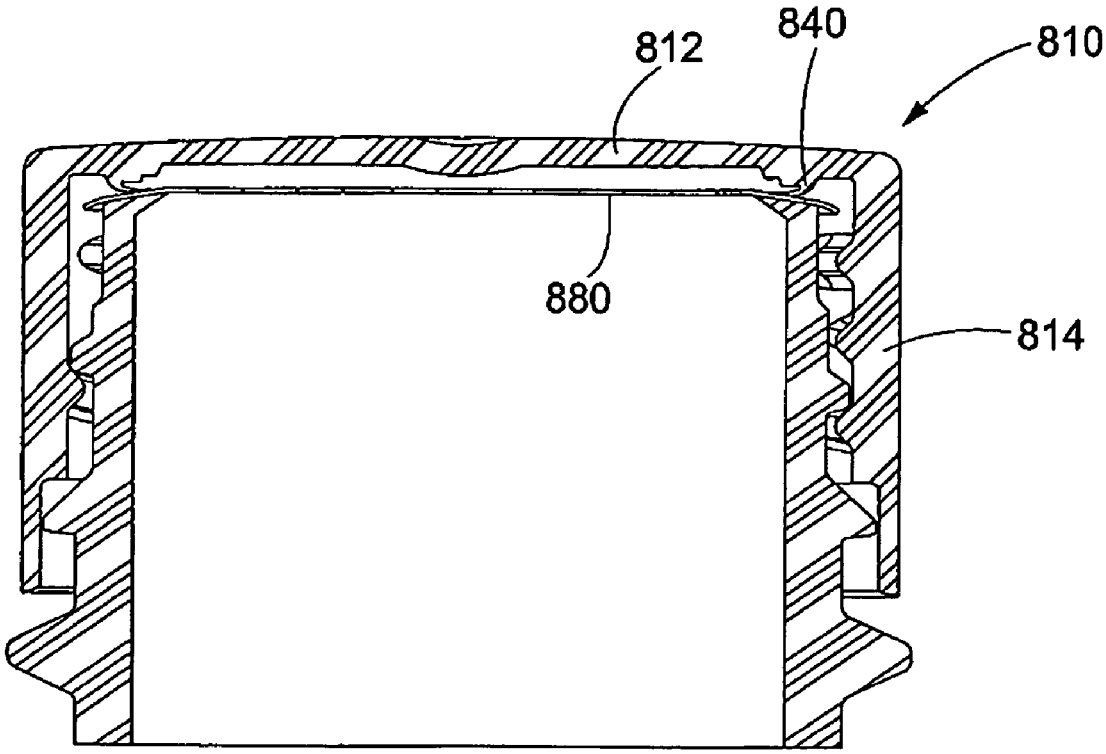

Referring still to FIG. 10, the reseal layer 440 has upper and lower tacky surfaces which tend to grip the inner surface of the top wall 412 above and may result in torque being transmitted to the inner seal 480 as it encounters the container mouth 468. This is an undesirable result as it is preferable that the reseal layer 440 rotate relative to the closure top wall 412. Thus, according to one exemplary embodiment of the present invention the reseal layer 440 includes at least one slip layer 442 affixed to at least one of the surfaces of the reseal layer 440 or the slip layer 442 may be affixed to the upper and lower surfaces as seen in FIG. 15. The slip layer 442 may be defined by a plurality of smooth, low friction substances able to withstand retort process temperatures and pressures including various polymeric materials such as polypropylene. The slip layer 442 may also include additives, which may include lubricants such as erucimide or Kememide to enhance friction reduction. According to a first alternative embodiment, the reseal layer 440 itself may include lubricants therein reducing the need for a distinct slip layer and in fact, the need for it to be unbound or even non-integral with the roof of the cap 442. According to yet another embodiment, the closure may contain a lubricant rather than or in addition to the lubricant in the reseal structure 440. One advantage to such a design is that the lubricants inhibit the peripheral edge of the reseal layer 440 from gripping the inner surface of the annular skirt 416 when sufficient torque is placed on the closure 410 causing the reseal layer 440 to compress and extrude outward. In another embodiment, the slip layer 412 is positioned on the innerseal layer 480 side of the reseal layer 440 whereby the reseal layer 440 may grip the roof of the cap 442 but the innerseal layer 480 does not rotate relative to the container lip 468. In yet a further alternative embodiment, shown in FIG. 16, the reseal layer or structure 640 may be bonded to the closure top wall 612. For instance, the reseal layer 640 may be compression molded into the closure top wall 612 and should be highly lubricated such that the coefficient of friction between the innerseal 680 and container lip 668 is greater than between the innerseal 680 and the cap 610. In yet a further alternative closure design shown in FIG. 17, the closure 710 has a top wall 712 with a plug seal 750. The plug seal 750 may or may not be used to seal a container. Disposed between the outer surface of the plug seal 750 and a closure skirt 714 is a reseal liner 740. The reseal liner 740 may be a slug of a polymeric material, such as PLASTISOL, which is heat cured in the roof of the closure 710 after the closure is formed. The reseal liner 740 engages the container neck rim once the foil seal 780 is removed. According to an even further embodiment, shown in FIG. 18, a closure 810 is shown having a top wall 812 and a skirt 814. Depending from the top wall 812 is a crab claw reseal liner 840 which sealably engages a container rim or mouth once a foil seal 880 is removed from the container neck. According to each of the embodiments depicted in FIGS. 16–18, the reseal liners 640, 740, 840 each have a slip agent integral therein or have a distinct slip layer such that the reseal liner does not grip the innerseal and cause the innerseal to rotate relative to the container neck. Alternatively, the upper surface of the foil seal 680, 780, 880 may have a distinct slip layer or integral slip agent to inhibit the reseal liner from grabbing the foil seal and causing rotation of the foil seal relative to the container neck.

Figure 12:
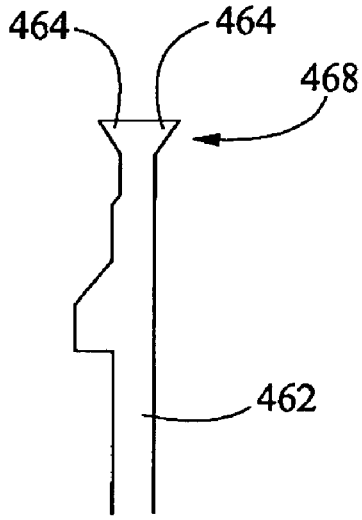
FIG. 12 is a side sectional view of an alternative container neck and sealing land.
Figure 13:
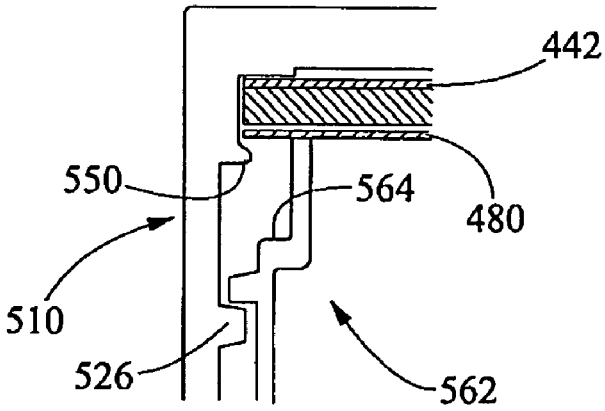
FIG. 13 is a side sectional view of an alternative closure engaging a second alternative container neck.
Figure 14:
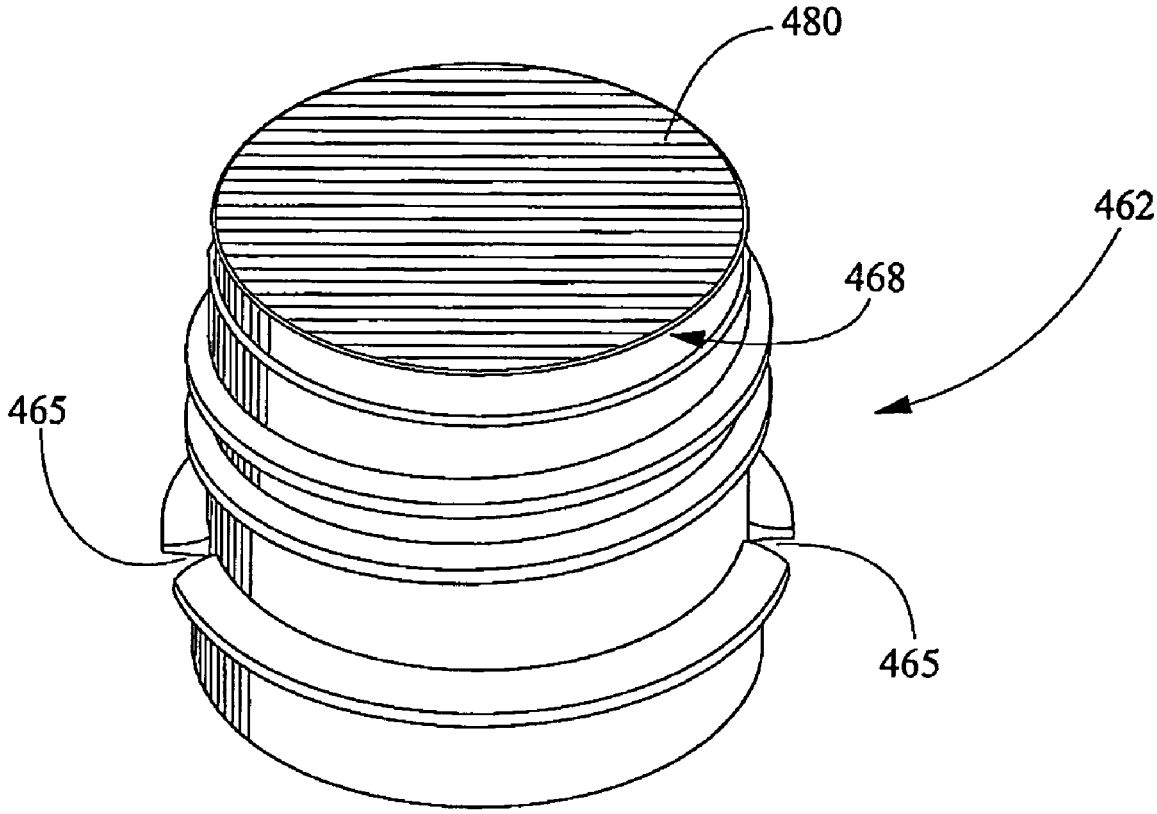
FIG. 14 is a perspective of a container neck finish.

Referring now to FIGS. 11, 12, and 13, various exemplary embodiments of a container neck are shown. However it is understood that various container neck sizes and shapes may be used with the instant closure design. The container neck 462 may have a rim or mouth defining an opening or mouth 468 in a container neck and providing a fluid path into an out of a container. The container neck 462 may include at least one projection 464 extending radially inward, radially outward, or both as shown in FIG. 12. The at least one projection 464 serves to widen the sealing land and may have a thickness of about one-tenth (1/10") of an inch. Providing a widened sealing land is advantageous since this design provides a path of increased length for any leakage. Moreover, the widened sealing land 464 provides increased contact area for the inner seal 480 and reseal layer 440 to engage thereby inhibiting rotation of the seal 480 or liner 440 relative to the container neck. According to the embodiment depicted in FIG. 11, the closure 410 having a jumped thread 426 is intended for use with a container neck having a substantially straight wall design. As previously discussed, the closure 410 of FIG. 11 has a jumped thread design, which provides space for the overhanging inner seal 480. Referring now to FIG. 13, an alternative container neck 562 and closure design is shown. The closure 510 is depicted with a thread 526 extending to top wall of the closure 510 and having a retaining structure 550 defined by a protuberance extending from an upper portion of thread 526 near the top wall of the closure. Since the thread 526 extends to the top wall there is no space provided for the overhanging portion of the inner seal 480. Thus the container neck 562 extends radially inward and upward from shoulder 564 providing a space of about 3/64 of an inch (3/64") for the overhanging inner seal 480. The container neck 462 may also include at least gap 465 in a container neck bead wherein process fluids may drain from between the container neck 462 and the closure 410.

In operation, the reseal layer 440 and inner seal 480 are snapped into place above the retaining structure 450 of the closure 410 so that the liner 440 and seal 480 can rotate freely within the closure 410. Once in place, the closure 410 is rotationally applied to a container neck and moves linearly downward along the neck. As the inner seal 480 engages the container neck, the seal grips the container neck. The slip layer 442 which abuts the stepped portion 413 of the roof of the closure 410 allows the closure to continue to rotate without gripping the reseal layer 440 and without placing damaging torque on the reseal layer 440 or the inner seal 480. In other words, the inner seal 480 has a coefficient of friction greater than slip layer 442. Thus, the reseal layer 440 stops rotating with the closure because the inner seal 480 stops rotating when it engages the container rim. After the closure 410 is positioned on the container neck, the container and closure are moved through an induction welding or other such heat welding process to seal the container. Next, the sealed container may go through a thermal sterilization or retort process and cooling bath.

When the container is initially opened by a consumer, the inner seal 480 is removed from the container rim. Upon replacement of the closure 410 on the container neck, the lower surface of the reseal layer 440 encounters the container rim and the tacky surface of the reseal layer 440 grabs the container rim, inhibiting rotation and preventing the reseal layer 440 from being damaged by the imperfections in the container rim. In addition, the slip layer 442 on the upper surface of the reseal layer 440 allows the closure 410 to rotate while the reseal layer 440 stops on the container rim. This inhibits transmission of damaging torque to the reseal layer 440. In other words, the coefficient of friction of the lower surface of the reseal layer 440 is greater than the coefficient of friction of the slip layer 442. Thus, only a downward force is placed on the reseal layer 440.

From a reading of the above, one of ordinary skill in the art should be able to devise variations to the inventive features described herein. These and other variations are believed to fall within the spirit and scope of the attached claims.

What is claimed is:

1. A closure for maintaining pressure against a peelable seal affixed to a container lip during a sterilization process, comprising:

a closure having a top wall and an annular skirt depending from said top wall;

a retaining structure extending radially inward from an inner surface of said annular skirt;

a reseal layer adjacent said top wall of said closure above said retaining structure; and, an inner seal positioned above said retaining structure abutting a lower surface of said reseal layer;

wherein at least one of said reseal layer and said inner seal has a slip layer;

said slip layer allowing one of said inner seal layer and said reseal layer to rotate relative to the other of said inner seal layer and said reseal layer during application of the closure to the container lip.

2. The closure of claim 1, said reseal layer being a flexible material.

3. The closure of claim 1, said reseal layer being selected from the group consisting of a silicone-based material, urethane, rubber, thermoplastic elastomers, or a combination thereof.

4. The closure of claim 1, said reseal layer formed of rubber.

5. The closure of claim 1, said reseal layer formed of rubber and synthetic olefin rubber.

6. The closure of claim 1, said slip layer affixed to said reseal layer.

7. The closure of claim 6, said slip layer formed of a polymeric material on a lower surface of said reseal layer.

8. The closure of claim 7 further comprising a second slip layer formed of a polymeric material and said reseal layer having a polymeric slip layer affixed to an upper surface of said reseal layer.

9. The closure of claim 1, said retaining structure being an interrupted bead circumferentially extending about an inner surface of said annular skirt.

10. The closure of claim 1, wherein said slip layer is formed of polypropylene and is affixed to a lower surface of said reseal layer.

11. The closure of claim 10, further comprising a second slip layer formed of polypropylene affixed to an upper surface of said reseal layer.

12. The closure of claim 1 wherein a coefficient of friction between said inner seal and a container lip is greater than between said inner seal and said closure top wall.

13. The closure of claim 1, a second slip layer affixed to an upper surface of said reseal layer containing at least one lubricant.

14. The closure of claim 1, an inner surface of said top wall having a stepped portion depending therefrom.

15. The closure of claim 1, said closure formed of a material containing a lubricant.

16. The closure of claim 1, said closure having at least one thread extending to said top wall.

17. The closure of claim 16, wherein an upper portion of said at least one thread includes a retaining structure extending therefrom.

18. The closure of claim 16, further comprising a container for use with said closure having a container neck finish including a shoulder extending radially inward providing a space of about 3/64 inch between said closure and said container neck finish.

19. The closure of claim 1, said slip layer formed of a polymeric material on an upper surface of said inner seal.

20. The closure of claim 1, said slip layer formed of a polypropylene material on an upper surface of said inner seal.

* * * * *